US006531013B2

(12) United States Patent
Nitowski

(10) Patent No.: US 6,531,013 B2
(45) Date of Patent: Mar. 11, 2003

(54) ADHESIVE BONDING PROCESS FOR ALUMINUM ALLOY BODIES INCLUDING HYPOPHOSPHOROUS ACID ANODIZING

(75) Inventor: Gary A. Nitowski, Leechburg, PA (US)

(73) Assignee: Alcoa Inc., Pittsburgh, PA (US)

( * ) Notice: Subject to any disclaimer, the term of this patent is extended or adjusted under 35 U.S.C. 154(b) by 128 days.

(21) Appl. No.: 09/855,969

(22) Filed: May 15, 2001

(65) Prior Publication Data

US 2002/0174940 A1 Nov. 28, 2002

(51) Int. Cl.[7] ..... C25D 11/08; C25D 11/18

(52) U.S. Cl. ..... 156/151; 205/201; 205/325; 148/253

(58) Field of Search ..... 156/150, 151; 205/199, 201, 324, 325; 148/253, 254

(56) References Cited

U.S. PATENT DOCUMENTS

| | | | | |
|---|---|---|---|---|
| 3,634,146 A | | 1/1972 | Wystrach et al. | 148/6.15 R |
| 4,085,012 A | | 4/1978 | Marceau et al. | 204/38 |
| 4,124,451 A | | 11/1978 | Dix et al. | 202/248 |
| 4,127,451 A | * | 11/1978 | Marceau et al. | 205/50 |
| 5,103,550 A | | 4/1992 | Wefers et al. | 29/527.4 |
| 5,126,210 A | * | 6/1992 | Wieserman et al. | 428/469 |
| 5,131,987 A | | 7/1992 | Nitowski et al. | 205/201 |
| 5,238,715 A | | 8/1993 | Wefers et al. | 428/34.4 |
| 5,324,587 A | | 6/1994 | Nitowski et al. | 428/469 |

FOREIGN PATENT DOCUMENTS

| | | |
|---|---|---|
| JP | 83006639 | 2/1983 |

* cited by examiner

*Primary Examiner*—Michael W. Ball
*Assistant Examiner*—John T. Haran
(74) *Attorney, Agent, or Firm*—Glenn E. Klepac

(57) ABSTRACT

An adhesive bonding process for making vehicle structures wherein a surface portion of an aluminum alloy body is anodized in an aqueous solution of hypophosphorous acid ($H_3PO_2$) to form an anodic oxide coating. A layer of adhesive is applied onto the surface portion and the adhesive coated anodized surface portion is joined to an adjacent metal structure.

The phosphorous acid anodizing is preferably carried out for less than 1 minute at about 5–40 volts and a current density of about 1–50 mA/cm$^2$ in a solution containing about 1–25 wt % hypophosphorous acid. Anodization time is more preferably about 10–30 seconds and is about 20 seconds in a particularly preferred embodiment.

15 Claims, 3 Drawing Sheets

ADHESIVE BONDING PROCESS FOR ALUMINUM ALLOY BODIES INCLUDING HYPOPHOSPHOROUS ACID ANODIZING

FIELD OF THE INVENTION

The present invention relates to an adhesive bonding process for incorporating aluminum alloy bodies into vehicle structures. More specifically, the invention relates to an adhesive bonding process wherein a surface portion of an aluminum alloy body is anodized in an acidic solution in preparation for adhesive bonding to an adjacent metal structure.

BACKGROUND OF THE INVENTION

Aluminum alloy components have achieved widespread use in aircraft and automotive applications because they are light and have high strength. Aircraft manufacturers join aluminum alloy bodies permanently to other metal structures, for example in stringers, wings, and aluminum-polymer laminates.

Before aluminum alloy bodies are adhesively bonded to other structures they are generally surface treated, for example by anodizing in an acidic solution. Anodizing in phosphoric acid is the preferred surface treatment in North America. Some patents disclosing phosphoric acid anodizing for aerospace structures include Marceu et al U.S. Pat. Nos. 4,085,012 and 4,127,451.

The choice of phosphoric acid over other electrolytes suitable for anodizing is related to the slower hydration rate of the phosphated oxide formed, which makes this oxide layer environmentally stable. Phosphoric acid anodizing produces excellent bond strengths and bond durability, but the process requires about 20 minutes thereby limiting it to batch processing. Accordingly, there still remains a need for a faster anodizing step in order to provide a continuous anodizing and coating process having reduced cost to airframers.

A principal objective of the present invention is to provide an adhesive bonding process including a hyposphosphorous acid anodizing step.

A related objective of the invention is to provide an adhesive bonding process including an acid anodizing step carried out more quickly than conventional, phosphoric acid anodizing processes.

An advantage of the adhesive bonding process of the present invention is that adhesive bond strength and durability are comparable to conventional processes even though processing time is reduced substantially.

Another advantage of the invention is that hypophosphorous acid anodizing avoids the potential environmental problems associated with anodizing processes utilitizing chromium compounds.

Additional objectives and advantages of the present invention will become apparent to persons skilled in the art from the following detailed description of a particularly preferred embodiment.

SUMMARY OF THE INVENTION

In accordance with the present invention, there is provided an improved process for adhesively bonding an aluminum alloy body to an adjacent metal structure. As used herein, the term "aluminum alloy" refers to an alloy containing at least about 85 wt % aluminum and one or more alloying elements that are not subversive to acid anodizing pretreatments. Some suitable alloying elements include copper, manganese, magnesium, silicon, zinc, and lithium. These alloying elements are sometimes called character imparting because alloys containing them derive characteristic properties from such elements.

Usually the amounts of such alloying elements are, as to each of copper, magnesium, and zinc, about 0.5 to 10% by weight of the total alloy; as to the element manganese, usually about 0.15 to 2% of the total alloy; as to silicon, usually about 0.25 to 15% of the total alloy; and as to the element lithium, about 0.2 to 3% of the total alloy. Iron and beryllium may also be present in aluminum alloys and can have a marked effect upon alloys containing them. Iron, for example, is often adjusted in amounts of about 0.3 to 2% by weight to perform specific functions and beryllium may be present in amounts of about 0.001 to 5% of the total alloy.

Various aluminum alloys in the form of sheet, plate, castings, and extrusions are suitable for practice of the present invention. Aluminum alloy sheet and plate are preferred. Suitable alloys for aluminum sheet and plate include heat treatable aluminum-copper alloys of the AA2000 series, aluminum-magnesium-silicon alloys of the AA6000 series, and aluminum-zinc alloys of the AA7000 series.

Aluminum alloy castings suitable for practice of the invention include die castings, sand castings, and permanent mold castings. One suitable casting alloy is alloy A356 with a nominal composition of 7.0 wt % Si, 0.3 wt % Mg, 0.17 wt % max Fe, 0.17 wt % max Cu, remainder aluminum, incidental elements, and impurities. The A356 alloy castings are commonly solution heat treated or aged at an elevated temperature before use. Two other useful alloys are C119 containing 9–10.5 wt % Si and 0.10–0.20 wt % Mg; and C448 containing 9.0–11.5 wt % Si, 0.4–0.8 wt % Mn, and 0.10–0.35 wt % Mg.

Aluminum alloy extrusions suitable for practice of the invention are preferably made from alloys containing silicon and magnesium in proportions allowing for heat treatment, such as the AA6000 series aluminum alloys. The AA6009, 6010, 6061, 6063, and similar alloys are useful, and the AA6061 and 6063 aluminum alloys are particularly preferred. Other useful alloys for extrusions include C210 containing 0.40–0.60 wt % Si, 0.15–0.25 wt % Cu, 0.40–0.60 wt % Mg, and 0.15–0.25 wt % Fe; and C461 containing 0.4–0.6 wt % Si, 0.15–0.40 wt % Fe, 0.45–0.70 wt % Mg, and 0.10–0.25 wt % V. Extruded aluminum alloy shapes are generally solution heat treated and quenched after they leave the extrusion die.

Vehicle assemblies for the aircraft and automotive industries must be built to exacting standards because of the extreme conditions they are subjected to in use. For example, aircraft wing structures for passenger, cargo, and military aircraft utilize adhesively bonded assemblies. Conditions of use involve extreme temperature variations ranging from below zero temperatures in arctic areas and temperatures greater than 150° F. (66° C.) in tropical areas where the assemblies are exposed to the sun. Aircraft assemblies are also exposed to atmospheric pollutants and other corrosive atmospheres. Of particular importance is resistance to corrosion and delamination of adhesively bonded structures in warm, humid environments. When adhesively bonded, metal-to metal vehicle assmeblies fail they must be replaced, thereby necessitating field repairs or even removal from operating service for extensive times so that repairs may be completed.

The present invention involves forming an anodic oxide coating on at least one surface portion of an aluminum alloy body, thereby rendering the surface portion susceptible to adhesion with various thermosetting or thermoplastic resins. Suitable adhesives include epoxies, polyurethanes, and acrylics. Epoxy adhesives are partiucalarly preferred.

Optionally, the surface portion to be anodized is cleaned to remove lubricants and other contaminants. Suitable surface cleaners include alkaline solutions, acidic solutions, and organic solvents including methylethyl ketone, acetone, and isopropanol.

The cleaned aluminum alloy body is anodized in an electrolyte in order to provide an anodic oxide coating on one or more surface portions, thereby rendering such surface portions suitable for adhesive bonding. The electroylyte contains about 1–25 wt % hypophosphorous acid ($H_3PO_2$), preferably about 3–15 wt %. Anodizing voltage is about 5–40 volts, preferably about 5–25 volts. Current density is about 1–50 mA/cm$^2$. An advantage of the invention is that a satisfactory anodic oxide coating can be obtain by anodizing for less than about 1 minute, preferably less than about 45 seconds. A preferred anodizing time is about 10–30 seconds, and a particularly preferred time is about 20 seconds.

Optionally, a suitable primer may be applied to the anodized surface portion before the adhesive. Some suitable primers are phenolic resins, epoxy resins, and epoxy-modified phenolics. A particularly preferred primer is an epoxy-modified phenolic sold by Cytec Industries under the name BR127.

A suitable adhesive is applied to the anodized aluminum alloy surface portion. The adhesive may be a thermoplastic or thermoselting resin selected from the epoxies, polyurethanes, and acrylics. A preferred adhesive is 3 M's AF-163-2k epoxy adhesive.

At least one layer of adhesive is applied to the anodized surface portion,and the adhesive coated surface portion is bonded to another metal structure to form a vehicle assembly. The other metal structure may comprise a metal selected from aluminum alloys, steel, and titanium.

DETAILED DESCRIPTION OF PREFERRED EMBODIMENTS

Figure 1:
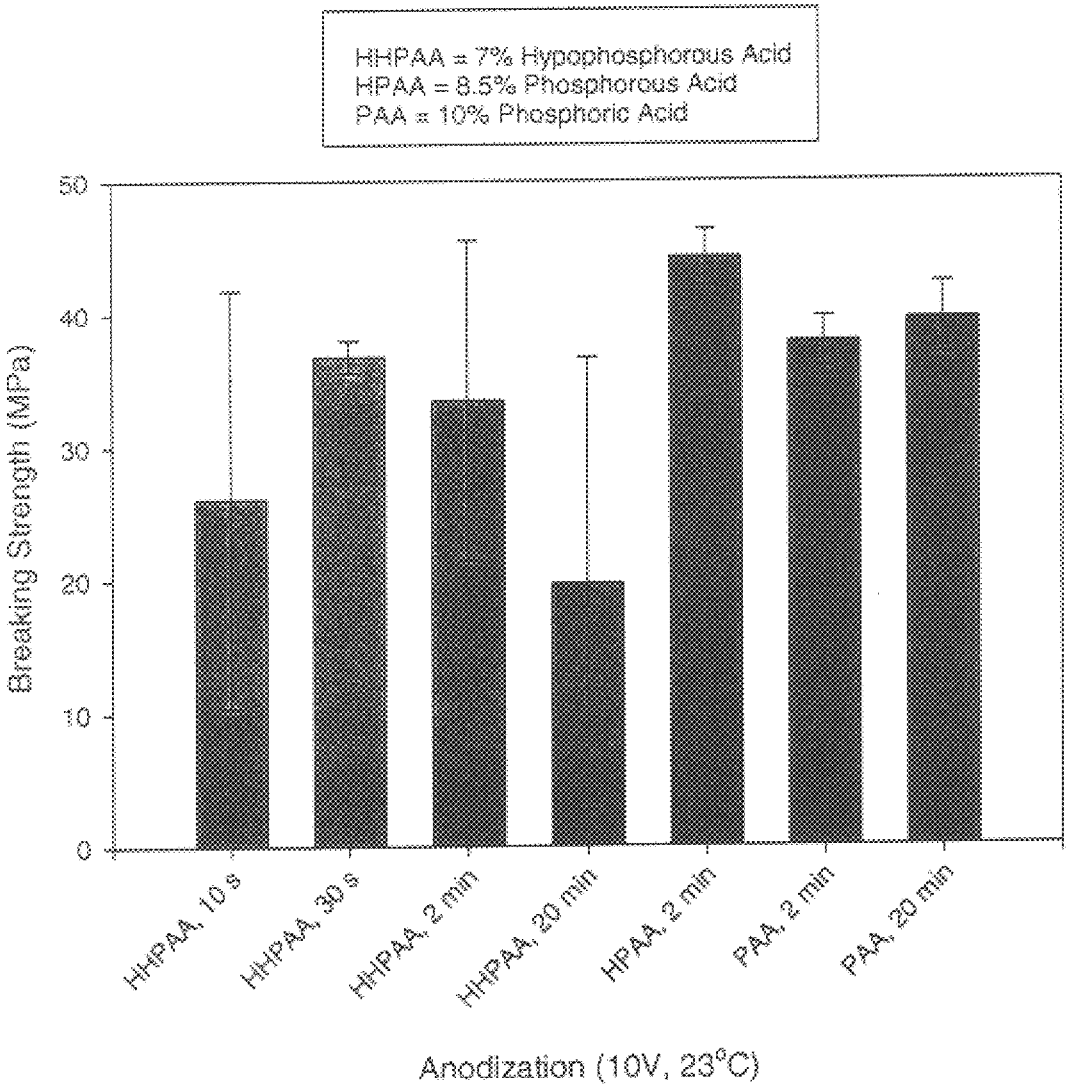
FIG. 1 is a graph of breaking strength as a function of electrolyte composition and anodization time.

Bare coupons of aluminum alloy 2024-T3 were degreased by wiping with a methyethyl ketone (MEK) soaked rag. The degreased coupons were alkaline cleaned in an alkaline cleaner for 2 minutes, immerison rinsed in city water, etched for 14 minutes at 63° C. (145° F.) in chromic-sulfuric acid etch, immersion rinsed, and spray rinsed with deionized water.

After etching, the samples were anodized in a stainless steel tank, which served as the cathode during anodization. Bath temperature was maintained at 23° C.±3° C. (73.4° F.±5.4° F.). The electrolyte solutions were vigorously stirred using a magnetic stirrer and a polytetrafluoroethylene coated stir bar. All electrolyte solutions were prepared with deionized water. A 10 wt % solution of phosphoric acid ($H_3PO_4$), an 8.5 wt % solution of phosphorous acid ($H_3PO_3$), and a 7 wt % solution of hypophosphorous acid ($H_3PO_2$) were used. These solutions are equivalent in terms of moles of phosphorus oxo acid per kilogram of water (1.134 molal). All samples were anodized potentiostatically at 10 V. Anodization times varied from 10 seconds to 20 minutes. After anodization, all samples were thoroughly rinsed with flowing deionized water, and dried with filtered pressurized air. The anodized metal was wrapped in laboratory tissue, and stored in a desiccator until application of the primer.

Within 24 hours of anodization, the samples were sprayed with BR 137 epoxy-modified phenolic primer sold by Cytec Industries Inc. The dried primer coating thickness was approximately 5.1 $\mu$m (200 $\mu$in). The primed adherends were stored in a desiccator until they were adhesively bonded.

The primed metal was adhesively bonded with 3M's AF163-2k epoxy film adhesive. Lap shear coupons (2.54×10.16×0.160 cm (1.0×4.0×0.063 in)) were bonded with three plies of the AF163-2k adhesive with a 1.27 cm (0.5 in) overlap using a lap shear fixture that maintains coupon alignment and provides a bondline thickness of 0.051 cm (0.020 in). The samples were cured for 1 hour at metal temparture of 121° C. (250° F.) without any applied pressure. Breaking strengths (load at failure/overlap area) were determined on an Instron Model 1127 tensile tester equipped with 222.4 KN (50,000 lb) load cell and a cross-head speed of 1.27 cm/min (0.5 in/min). Stress strain curves were recorded on a strip chart recorder with 22.24 KN (5,000 lb) full scale. Reported average breaking strengths and one standard deviation errors are from five joints.

Primed wedge test panels (15.24×22.86×0.318 cm (6.0×9.0×0125 in)) were bonded using 2-plies of AF163-2k adhesive. A bondline thickness averaging 0.038 cm (0.015 in) was achieved by using 0.051 cm (0.020 in) thick Mylar brand polyester shim stock at the edges of the panels. The wedge test assemblies were cured in a platen press. The assemblies were inserted into the press at room temperature and a pressure of 0.085 Mpa (12.3 psi) was applied. The temperature of the platens was ramped at 11.1° C./min (20° F./min) to a curing temperature of 121° C. (250° F.). The assemblies were held at temperature for 1 hour, whereupon the press was opened and the bonded assemblies were allowed to cool to room temperature. Five replicate wedge test samples were machined from the assemblies and tested according to ASTM D3762-79 (1983). Average wedge test crack lengths before and after exposure to 50° C. (122° F.) and 100% relative humidity (R.H.) with one standard deviation error bars are reported in Table 1 and graphically in FIG. 1.

TABLE 1

Average lap shear breaking strengths with one standard deviation of anodized 1024-T3, primed with BR 127 primer and bonded with AF163-2k epoxy adhesive for specimens anodized in hypophosphorous acid (HHPAA) phosphorous acid (HPAA), and phosphoric acid (PAA)

| | Average Breaking Strength | | One Standard Deviation | |
|---|---|---|---|---|
| Anodization | (MPa) | (psi) | (MPa) | (psi) |
| 10 second HHPAA | 26.1 | 3781 | 15.7 | 2284 |
| 30 second HHPAA | 36.8 | 5331 | 1.2 | 170 |
| 2 minute HHPAA | 33.5 | 4866 | 12.0 | 1735 |
| 20 minute HHPAA | 19.7 | 2864 | 17.0 | 2465 |
| 2 minute HPAA | 44.2 | 6410 | 2.1 | 305 |
| 2 minute PAA | 37.9 | 5502 | 1.9 | 271 |
| 20 minute PAA | 39.6 | 5745 | 2.7 | 387 |

There is large scatter in the 10 second hypophosphorous acid (HHPAA), the 2 minute HHPAA, and the 20 minute HHPAA. The scatter for each of these conditions was due to one lap shear speciman failing with low breaking strength. Failure analysis revealed that the bonds failed within the anodic oxide; indicating that the anodic oxide is mechanically weak. All of the other lap shear specimens failed cohesively in the adhesive; adhesive was observed on both sides of the failed specimens that exhibited higher strengths.

Reasons for a low observed breaking strength for a 10-second HHPAA lap joint are not understood.

The environmental durablity of the adhesive bonds was determined by the wedge test. Good durability as indicated by the wedge test is characterized by low crack growth after exposure to humidity. Wedge test data for short-term HHPAA are compared with those of industry standard 20-minute phosphoric acid (PAA) data in FIG. 2.

It is seen that anodization for 10–30 seconds in hypophosphorous acid (HHPAA) solution provides durablity that is comparable to a 20-minute anodization in phosphoric acid (PAA 20 min). It is further noted that anodization for 30 seconds in either phosphoric acid (PAA 30 sec), or phosphorous acid (HPAA 30 sec) does not provide the required durability to the adhesive bonds.

Figure 3:
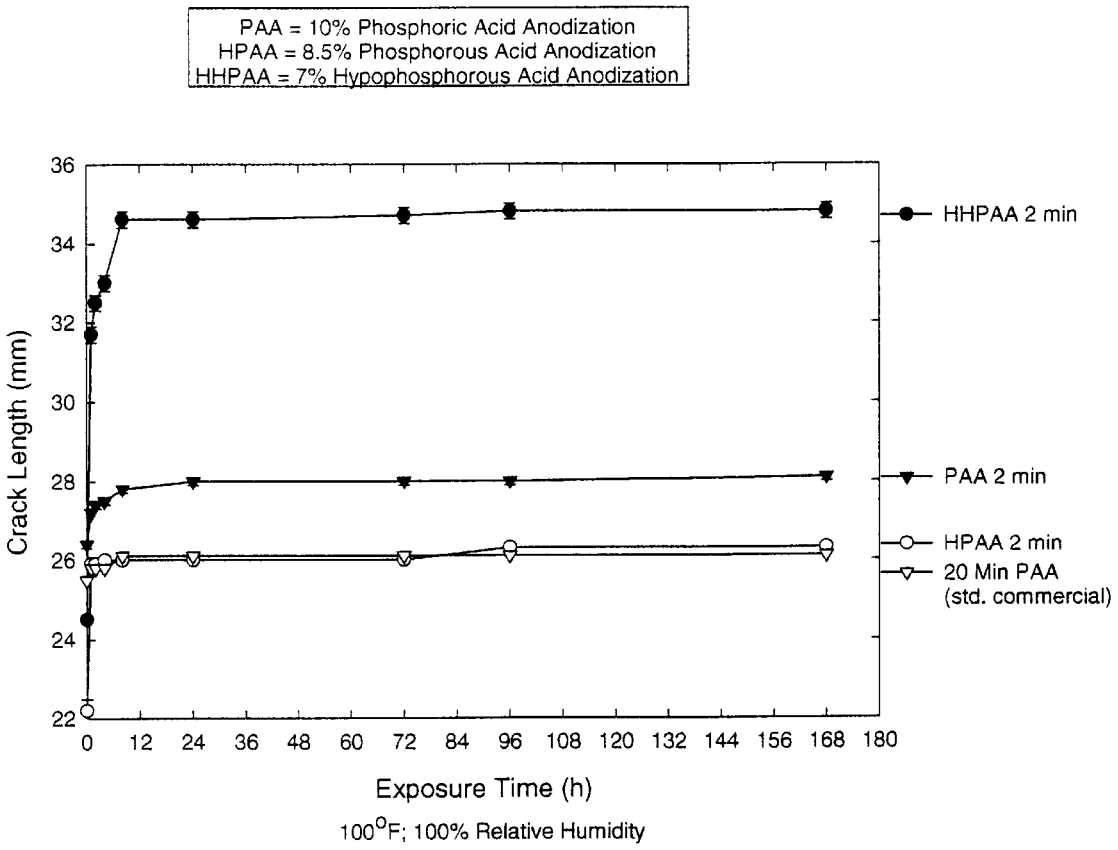

The wedge test data of FIG. 3 show that a 2-minute phosphorous acid anodizing process (HPAA) is comparable with the industry standard 20-minute PAA process.

Figure 2:
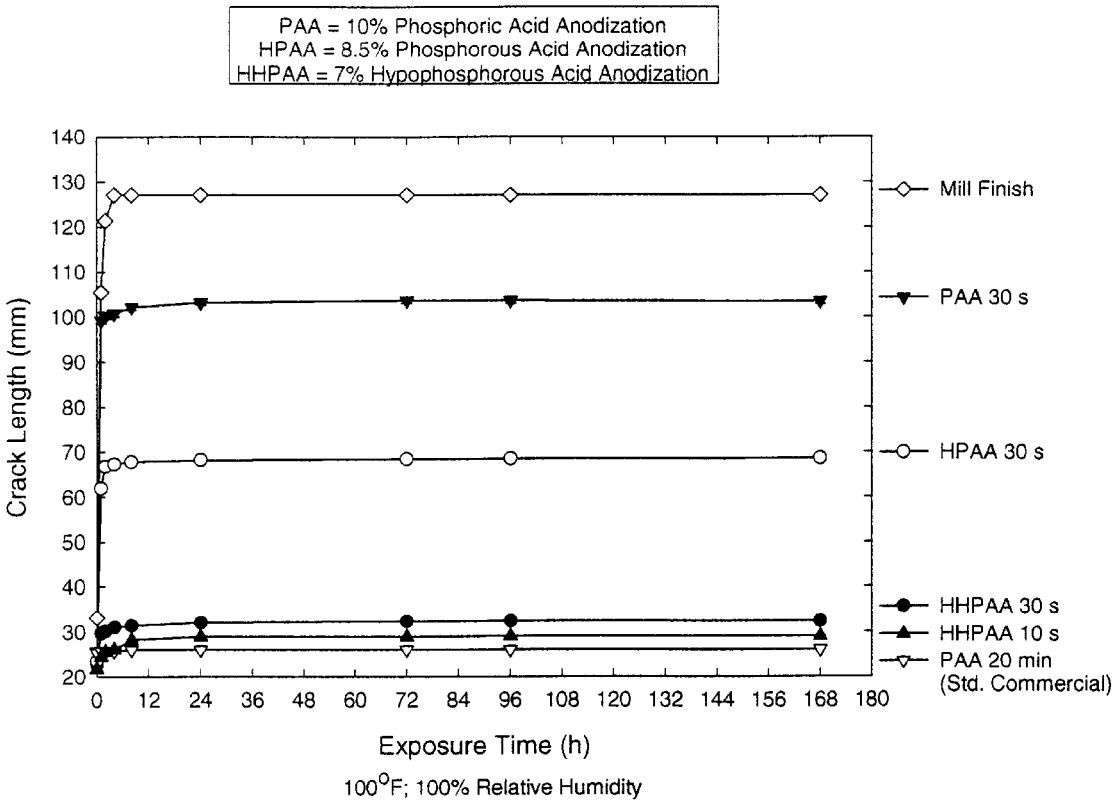
FIGS. 2 and 3 are graphs of crack length as a function of exposure time in a wedge test.

It is also noticed from comparisons of FIG. 2 and FIG. 3 that the durability of joints with hypophosphorous acid anodized (HHPAA) adherends significantly decreases when the anodization time is increased from 30 seconds to 2 minutes.

Having described the presently preferred embodiments, it is to be understood that the invention may be otherwise embodied within the spirit and scope of the appended claims.

What is claimed is:

1. A process for making a vehicle assembly by joining an aluminum alloy body to an adjacent metal structure, comprising a) providing an aluminum alloy body having a surface portion, b) anodizing said surface portion in an electrolyte comprising an aqueous solution of hypophosphorous acid ($H_3PO_2$) to form an anodic coating on said surface portion suitable for adhesive bonding, c) applying a layer of adhesive onto the anodized surface portion, and d) joining the adhesive coated surface portion to a metal structure adjacent said body, thereby to form a vehicle assembly.

2. The process of claim 1 wherein said body comprises an aluminum alloy selected from aluminum-copper alloys of the AA 2000 series, aluminum-magnesium-silicon alloys of the AA 6000 series, and aluminum-zinc alloys of the AA 7000 series.

3. The process of claim 1 wherein the anodizing is carried out for a time of less than about 1 minute.

4. The process of claim 1 wherein the anodizing is carried out for a time of less than about 45 seconds.

5. The process of claim 1 wherein the anodizing is carried out for a time of about 10–30 seconds.

6. The process of claim 1 wherein the anodizing is carried out at a voltage of about 5–40 volts.

7. The process of claim 1 wherein the anodizing is carried out at a current density of about 1–50 $mA/cm^2$.

8. The process of claim 1 wherein the aqueous solution comprises about 1–25 wt % hypophosphorous acid.

9. The process of claim 1 wherein the aqueous solution comprises about 3–15 wt % hypophosphorous acid.

10. The process of claim 1 wherein said adhesive comprises a thermoplastic or thermosetting resin selected from epoxies, polyurethanes, and acrylics.

11. The process of claim 1 wherein said adhesive comprises an epoxy resin.

12. The process of claim 1 wherein said metal structure comprises at least one metal selected from the group consisting of aluminum alloys, steel, and titanium.

13. A process for making a vehicle assembly comprising an aluminum alloy body and at least one other metal structure, comprising a) providing an aluminum alloy body having a surface portion, said body comprising an alloy selected from aluminum-copper alloys of the AA2000 series, aluminum-magnesium-silicon alloys of the AA6000 series, and aluminum-zinc alloys of the AA7000 series;

b) anodizing said surface portion for less than 1 minute in an aqueious solution containing about 1–25 wt % hypophosphorous acid, thereby to provide an anodic coating on said surface portion;

c) applying a layer of adhesive to said surface portion, said adhesive comprising a thermoplastic or thermoselting resin selected from epoxies, polyurethanes, and acrylics, and d) joining said adhesive coated surface portion to a metal structure, thereby to form a vehicle assembly.

14. The process of claim 1, wherein said aluminum alloy body comprises an aluminum-copper alloy of the AA2000 series.

15. A vehicle assembly made by the process of claim 1.

* * * * *